US005408928A

United States Patent [19]

Junghans et al.

[11] Patent Number: 5,408,928

[45] Date of Patent: Apr. 25, 1995

[54] PRINTING PRESSES WITH INKING UNITS

[75] Inventors: Rudi Junghans, Wilhelmsfeld; Lothar Stein, Sandhausen, both of Germany

[73] Assignee: Heidelberger Druckmaschinen Aktiengesellschaft, Heidelberg, Germany

[21] Appl. No.: 121,603

[22] Filed: Sep. 14, 1993

[30] Foreign Application Priority Data

Sep. 16, 1992 [DE] Germany ..... 42 30 947.6

[51] Int. Cl.[6] ..... B41F 1/10; B41F 31/32

[52] U.S. Cl. ..... 101/350; 101/352; 101/485

[58] Field of Search ..... 101/352, 350, 351, 349, 101/247, 207, 208, 209, 210, 483, 485

[56] References Cited

U.S. PATENT DOCUMENTS 4,520,729 6/1985 Fischer ..... 101/352
4,625,642 12/1986 Despot et al. .
4,882,991 11/1989 Simeth .

FOREIGN PATENT DOCUMENTS 2106655 8/1972 Germany .
2902047 7/1979 Germany .
3641013 10/1987 Germany .

*Primary Examiner*—J. Reed Fisher
*Attorney, Agent, or Firm*—Nils H. Ljungman & Associates

[57] ABSTRACT

An inking unit for rotary printing machines comprising driven distributor rollers, inking-unit rollers and plate-inking rollers which are mounted so as to be disengageable from a plate cylinder such that, when adjusting an inking-unit roller, the contact pressure is maintained at a constant level and the adjustment itself can be largely remote-controlled.

20 Claims, 4 Drawing Sheets

PRINTING PRESSES WITH INKING UNITS

BACKGROUND OF THE INVENTION

1. Field of the Invention

The present invention generally relates to an inking unit for rotary printing machines, wherein such an inking unit comprises driven distributor rollers, inking-unit rollers and plate-inking rollers which are mounted so as to be disengageable from a plate cylinder.

2. Background Information

With inking units such as that just described, as disclosed in German Patent Publication No. 21 06 655, various adjusting steps are generally effected in the area of the inking-unit rollers in order to influence the ink flow within the inking unit or to engage the plate-inking rollers at the plate cylinder and disengage them therefrom, for example. There are often provided complicated mechanical means to ensure that such adjusting steps are effected accurately, and to also ensure that, in each case, the individual rollers are precisely positioned with respect to their working position. Furthermore, it is usually necessary to perform certain adjusting steps at the rollers by hand, which can tend to be time-consuming in view of operating the machine.

OBJECT OF THE INVENTION

Proceeding from the facts set forth above, it is the object of the present invention to largely avoid any manual adjustment of the rollers and to maintain adjusting pressure at an essentially constant level while performing individual adjusting steps.

SUMMARY OF THE INVENTION

According to the present invention, the above object is achieved by mounting an inking-unit roller with its guidances and spring element on a swivel bearing. The swivel bearing can be swivelled via an adjusting means such that the inking-unit roller is disengaged from a first neighboring distributor roller, whereas the contact to a second neighboring roller is maintained. Due to this setting, the ink flow may be varied, for example, without varying the contact pressure of the rollers; with contemporary machines said setting may be advantageously effected by means of an electrical servomotor. The members, or components, used are simple as to their design and thus cost-saving, and do not usually require any manual re-adjustment during machine-operation.

An advantageous embodiment of the present invention is characterized in that an inking-unit roller and at least one plate-inking roller are assigned to the distributor roller; that a further inking-unit roller, connecting the aforementioned rollers, is mounted on a bearing bracket which can be swivelled about a distributor roller such that the rolling contact of the inking-unit roller with the following inking-unit rollers is maintained; and that the plate-inking roller is disengaged from the plate cylinder. By mounting the inking-unit roller on a bearing bracket the adjusting steps effected inside the inking unit are maintained even if the plate-inking rollers are disengaged from the plate cylinder; the adjustment of the bearing bracket can be performed via the adjusting means of the engaging/disengaging means of the plate-inking rollers in a known manner.

In summary, one aspect of the invention resides broadly in a printing press comprising: a frame; a plate cylinder being rotatably mounted on the frame; an ink reservoir for holding a supply of ink; an inking mechanism for transferring the ink between the ink reservoir and the plate cylinder during operation of the printing press; the inking mechanism comprising a plurality of inking rollers, at least one ink fountain roller and at least one transfer roller for transferring ink between the ink fountain roller and at least one of the plurality of inking rollers; a plurality of ink applicator rollers for being engaged with the plate cylinder and for: receiving ink from the plurality of inking rollers; and applying ink to the plate cylinder; the plurality of inking rollers comprising a first inking roller, a second inking roller and a third inking roller; means for displacing the first inking roller between a first position and a second position, the first inking roller being rotatingly engaged with both the second inking roller and the third inking roller in the first position, and the inking roller being disengaged from the second inking roller and rotatingly engaged with the third inking roller in the second position; the displacing means comprising: means for accepting a non-orbital movement and translating the non-orbital movement into a pivoting movement of the first inking roller about the third inking roller to displace the first inking roller between the first position and the second position.

Another aspect of the invention resides broadly in an inking unit for a printing press, the printing press comprising a frame and a plate cylinder being rotatably mounted on the frame, the inking unit comprising: an ink reservoir for holding a supply of ink; an inking mechanism for transferring the ink between the ink reservoir and the plate cylinder during operation of the printing press; the inking mechanism comprising a plurality of inking rollers, at least one ink fountain roller and at least one transfer roller for transferring ink between the ink fountain roller and at least one of the plurality of inking rollers; a plurality of ink applicator rollers for being engaged with the plate cylinder and for: receiving ink from the plurality of inking rollers; and applying ink to the plate cylinder; the plurality of inking rollers comprising a first inking roller, a second inking roller and a third inking roller; means for displacing the first inking roller between a first position and a second position, the first inking roller being rotatingly engaged with both the second inking roller and the third inking roller in the first position, and the inking roller being disengaged from the second inking roller and rotatingly engaged with the third inking roller in the second position; the displacing means comprising: means for accepting a non-orbital movement and translating the non-orbital movement into a pivoting movement of the first inking roller about the third inking roller to displace the first inking roller between the first position and the second position.

Yet another aspect of the invention resides broadly in a method of operating a printing press and printing a printed product, the method comprising the steps of: providing a frame; providing a plate cylinder and rotatably mounting the plate cylinder on the frame; providing an ink reservoir for holding a supply of ink; providing an inking mechanism for transferring the ink between the ink reservoir and the plate cylinder during operation of the printing press; the step of providing an inking mechanism further comprising the step of providing a plurality of inking rollers, at least one ink fountain roller and at least one transfer roller for transferring ink between the ink fountain roller and at least one of the plurality of inking rollers; providing a plurality of ink applicator rollers for being engaged with the plate cylinder and for: receiving ink from the plurality of inking rollers; and applying ink to the plate cylinder; the step of providing a plurality of inking rollers comprising the step of providing a first inking roller, a second inking roller and a third inking roller; providing means for displacing the first inking roller between a first position and a second position, the first inking roller being rotatingly engaged with both the second inking roller and the third inking roller in the first position, and the inking roller being disengaged from the second inking roller and rotatingly engaged with the third inking roller in the second position; the step of providing the displacing means comprising the step of providing means for accepting a non-orbital movement and translating the non-orbital movement into a pivoting movement of the first inking roller about the third inking roller to displace the first inking roller between the first position and the second position; the method further comprising the additional steps of: initiating operation of the printing press; transferring ink between the ink reservoir and the plate cylinder; the transferring step comprising the step of transferring the ink between the ink fountain roller and at least one of the plurality of ink applicator rollers; engaging the plurality of ink applicator rollers with the plate cylinder; applying ink to the plate cylinder by means of the plurality of ink applicator rollers; displacing the first inking roller between the first position and the second position; the displacing step comprising the step of: accepting, at the accepting means, a non-orbital movement and translating the non-orbital movement into a pivoting movement of the first inking roller about the third inking roller to displace the first inking roller between the first position and the second position.

BRIEF DESCRIPTION OF THE DRAWINGS

A specimen embodiment of the invention is schematically illustrated in the drawings, wherein.

DESCRIPTION OF THE PREFERRED EMBODIMENT

Figure 1:
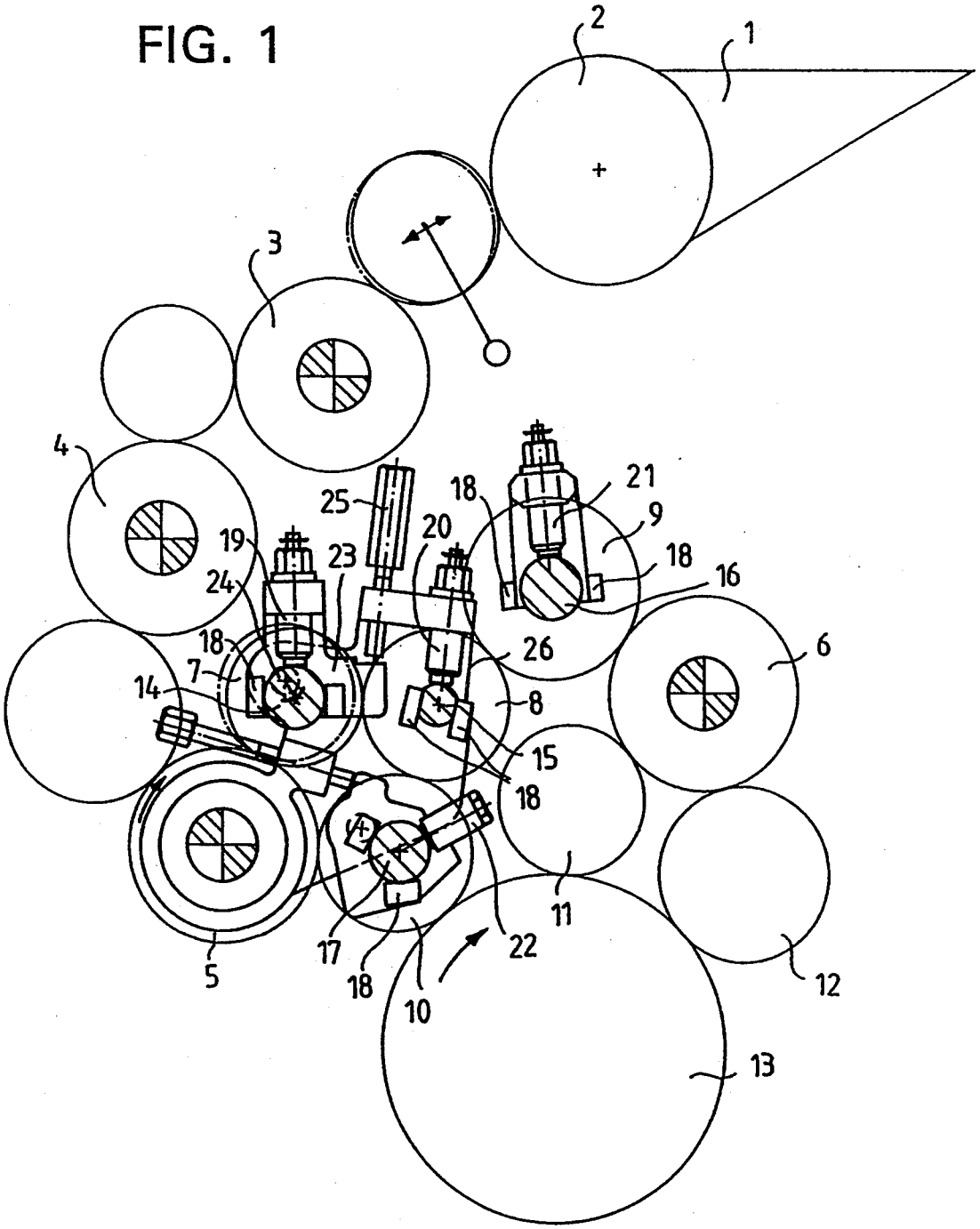
FIG. 1 is a side elevational view of an inking unit being in a first adjusting position.

The inking unit illustrated in FIG. 1 comprises an ink fountain 1 with a fountain roller 2, a plurality of distributor rollers 3 through 6 and inking-unit rollers 7 through 9. Moreover, there are shown three plate-inking rollers 10 through 12 which are assigned to a plate cylinder 13.

The inking-unit rollers 7 through 10 are preferably mounted with their journals 14 through 17 on tangentially provided guidances 18 and are preferably radially loaded via corresponding spring elements 19 through 22. In its position shown in FIG. 1, the inking-unit roller 7 is engaged with the distributor roller 5 and the inking-unit roller 8 via the spring element 19. The inking-unit roller 8 may also preferably be engaged with the plate-inking roller 10 and the inking-unit 7 via a spring element 20. The inking-unit roller 9 is preferably engaged with the inking-unit roller 8 and the distributor roller 6 via the spring element 21. With the aid of a tensioning element, or spring element, 22, the roller 10 can preferably be held in its bearings. Adjustment can preferably be effected by means of separate adjusting screws.

Thus, in accordance with a preferred embodiment of the present invention, each of the inking rollers 7, 8, 9 and 10 is preferably mounted such that the journals 14 of each of the rollers 7, 8, 9, 10 is mounted between corresponding tangential guidances 18. Preferably, each inking roller 7, 8, 9, 10 is radially loaded by means of a corresponding spring element, or tensioning element, 19, 20, 21, and 22. Preferably, inking roller 7 is engaged with distributor roller 5 and is selectively engageable, in a manner described more fully below, with a neighboring inking roller 8. Preferably, distributor roller 5 is also engaged with a plate inking roller 10. Furthermore, distributor roller 5 is preferably mounted so as to receive ink, via ink fountain 1 and fountain roller 2, from a train of inking unit rollers, which train of rollers preferably also includes distributor rollers 3 and 4. Preferably, inking roller 8 is engaged both with plate inking roller 10 and another inking roller 9. Finally, inking roller 9 is preferably engaged with another distributor roller 6, which in turn is preferably engaged with plate inking rollers 11 and 12. As shown, plate inking roller 10 is preferably the first plate inking roller adjacent plate cylinder 13 when viewed in the direction of rotation of the plate cylinder 13, followed by plate inking roller 11, followed by plate inking roller 12. The direction of rotation of plate cylinder 13 is indicated by an arrow in FIG. 1.

Preferably, plate inking roller 10 can be held in its bearings 18 with a tensioning element 22. Conceivably, such a tensioning element could be embodied by, for example, a tensioning spring, which tensioning spring, in turn, could be adjusted by means of an adjusting screw (not shown) provided at an end of the tensioning spring.

In the specimen embodiment shown in FIG. 1, the inking-unit roller 7, with its guidances 18 and the spring element 19, is preferably mounted on a swivel bearing 23 which can be swivelled about a point of rotation 24. The swivel bearing 23 can preferably be swivelled via an adjusting means 25, which may, for example, be a servomotor. If a manual adjustment is to be performed by means of adjusting means 25, an adjusting screw may preferably be provided instead of a servomotor.

By actuating the adjusting means 25, whether by way of a screw motion or other type of motion, the swivel bearing 23 may be swivelled about the point of rotation 24 so that the inking-unit roller 7 is swivelled from the position indicated by a solid line into the dash-dotted position and so that the contact of the inking-unit roller 7 with the inking-unit roller 8 is interrupted, and whereas the contact of the inking-unit roller 7 with the distributor roller 5 remains unchanged.

Figure 1A:
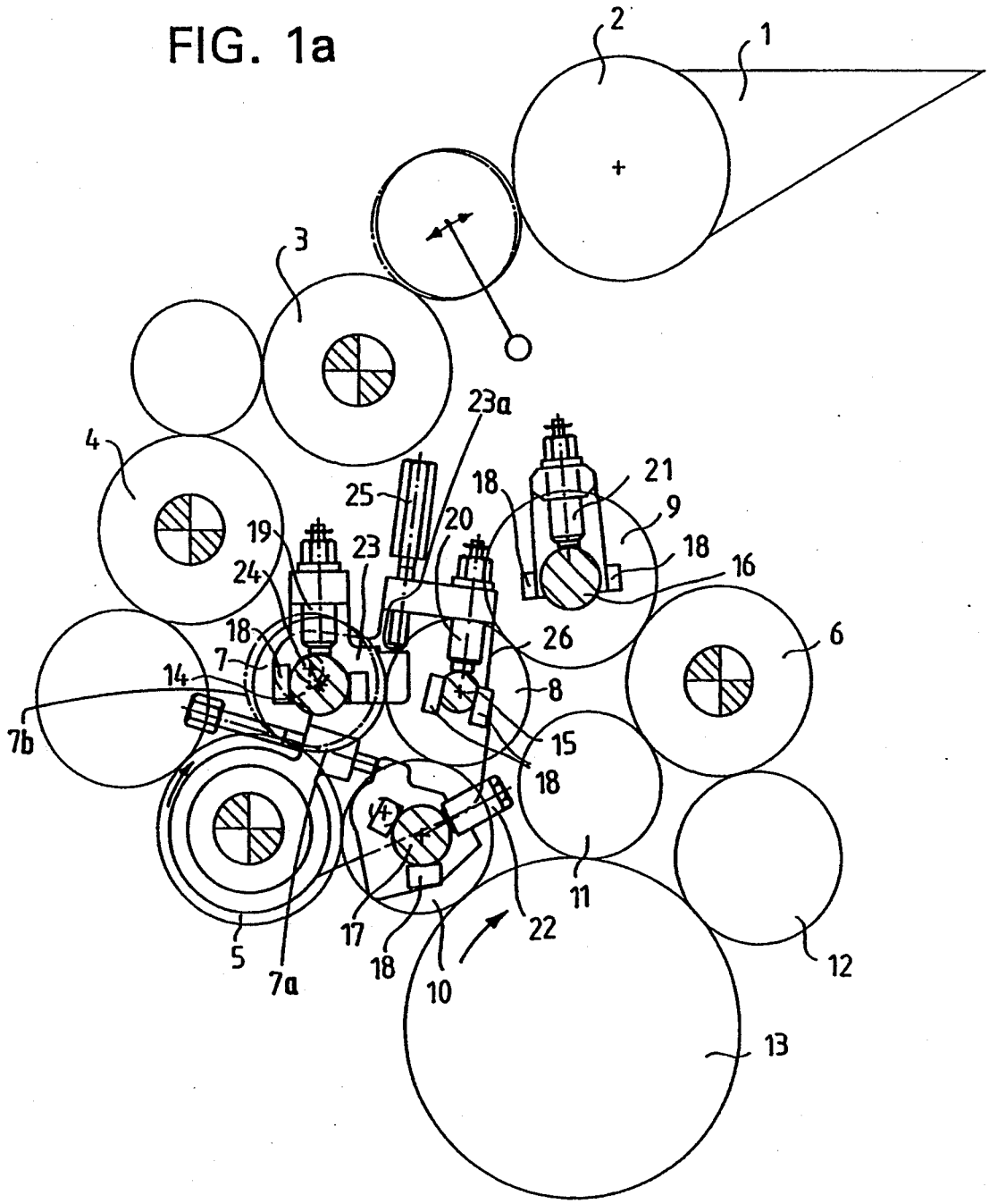
FIG. 1*a* is essentially the same view as FIG. 1, but shows additional components.

FIG. 1*a* shows solid line 7*a*, indicating a position in which inking-unit roller 7 is engaged with inking-unit roller 8, as well as dash-dotted line 7*b*, indicating a position in which inking-unit roller 7 is disengaged from inking-unit roller 8.

Figure 2:
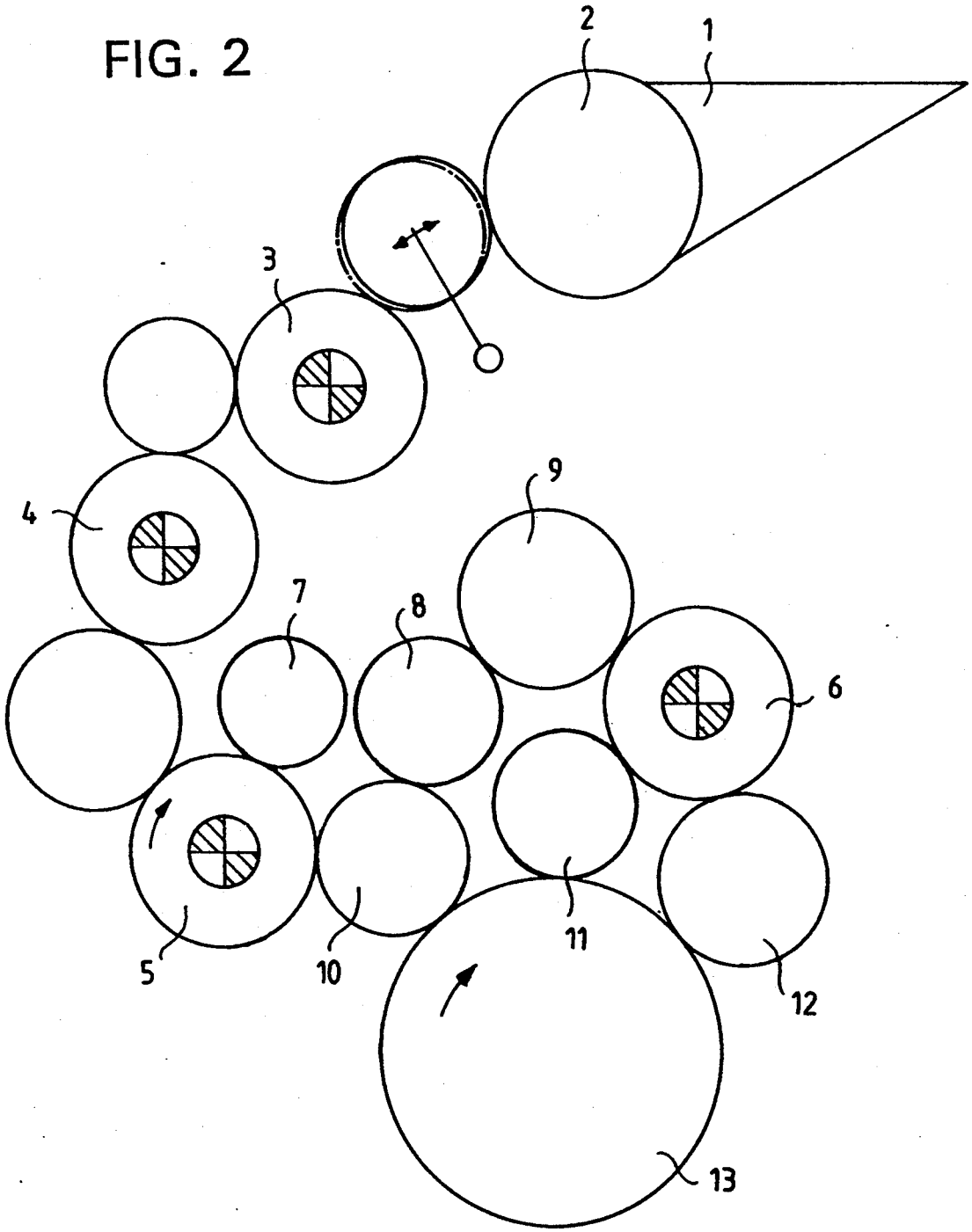
FIG. 2 shows the inking unit in a second adjusting position.

FIG. 2 shows the inking-unit roller 7 in a position in which it is disengaged from the inking-unit roller 8, corresponding to the dash-dotted line 7*b* in FIG. 1*a*, whereby the ink flow in the inking unit may be varied. In FIG. 1, which shows the inking-unit roller 7 in its engaged position, corresponding to the solid line 7a in FIG. 1*a*, the major portion of ink will essentially be supplied to the plate-inking roller 10, whereas the plate-inking rollers 11 and 12 apply onto the plate cylinder only a small portion of ink. In FIG. 2, the inking-unit roller 7 and the inking-unit roller 8 are out of contact with each other so that the main ink flow is supplied to the plate-inking roller 10, whereas the plate-inking rollers 11 and 12 merely serve, essentially, to uniformly distribute the ink application on the plate cylinder 13. In this latter position, in which the inking-unit roller 7 and the inking-unit roller 8 are out of contact with one another, the inking-unit roller 7 essentially has the function of a rider roller on the distributor roller 5. Generally, it should be kept in mind that specific print jobs usually require different ink supply.

Thus, in accordance with a preferred embodiment of the present invention, inking roller 7' is preferably mounted on a swivel bearing 23 along with its guidances 18 and spring element 19. Preferably, as shown, the swivel bearing 23 is swivellable, or pivotable, about a point of rotation, or pivot point, 24. Preferably, pivot point 24 is offset a small distance from the axis of rotation of inking roller 7, preferably in a direction away from plate inking roller 10 and towards distributor roller 4, as shown in FIG. 1. Preferably, an adjusting means, or adjusting device, 25 is provided to impart motion to the swivel bearing 23. Preferably, adjusting device 25 is embodied by a servomotor, but may also be embodied by an adjusting screw.

Preferably, adjusting device 25 is preferably configured to provide an essentially linear movement to swivel bearing 23, which essentially linear movement is thence preferably translated into a pivoting movement of swivel bearing 23 about pivot point 24. Thus, in accordance with the present invention, adjusting device 25 and swivel bearing 23 are preferably interconnected in such a manner that generally provides a translation of linear movement of adjusting device 25 into a pivoting movement of swivel bearing 23. FIG. 1*a* schematically illustrates a medium of interconnection along such lines, indicated at 23*a*. In this regard, adjusting device 25 may, for example, be embodied by a screw servomotor or an adjusting screw and, accordingly, may be configured to interact with corresponding threads on swivel bearing 23. Alternatively, for example, adjusting device 25 may be embodied by a suitable linear actuator, at the end of which a loose bolt connection may preferably be provided with swivel bearing 23. In such an arrangement, such a bolt connection would preferably be configured such that a linear movement of adjusting device 25 would result in a pivoting movement of swivel bearing 23.

Essentially, when swivel bearing 23 is pivoted, in accordance with the present invention, as shown in FIG. 1, inking roller 7 will preferably disengage from inking roller 8 and move away from inking roller 8. During such movement of inking roller 7, constant contact is preferably maintained between inking roller 7 and distributor roller 5. In so doing, the contact pressure between inking roller 7 and distributor roller 5 may preferably remain constant. Thus, in accordance with a preferred embodiment of the present invention, swivel bearing 23 is preferably configured, and mounted, such that, when swivel bearing 23 is pivoted, inking roller 7 will essentially:

engage or disengage with inking roller 8;

maintain continuous contact with distributor roller 5 during such engagement or disengagement; and preferably maintain an essentially constant contact pressure with respect to distributor roller 5 during such engagement or disengagement and also once inking roller 5 has reached the desired position.

In order to be able to disengage the plate-inking roller 10 from the plate cylinder 13, without influencing the settings of the other rollers, the inking-unit rollers 7 and 8 and the plate-inking roller 10 are preferably mounted on a bearing bracket 26 which can preferably be swivelled about distributor roller 5. Approximately on the line connecting distributor roller 5 and inking-unit roller 9, the inking-unit roller 8 is preferably provided on the bearing bracket 26 so that, by swivelling the bearing bracket 26, the inking-unit roller 8 essentially remains in rolling contact with the following inking-unit roller 9. The bearing bracket 26 may preferably be swivelled via the adjusting means, provided at the plate cylinder 13, for engaging and disengaging the plate-inking rollers 10 through 12. When disengaging the plate-inking roller 10 from the plate cylinder, the settings of the rollers 5, 7, 8, 9, and 10 essentially do not change.

Thus, in accordance with a preferred embodiment of the present invention, in order to be able to disengage the plate inking roller 10 from plate cylinder 13 without influencing the settings of other rollers, inking rollers 7 and 8, as well as plate inking roller 10, may preferably be mounted on a bearing bracket 26. Such a bearing bracket 26 may preferably be pivotably mounted so as to pivot about distributor roller 5. Preferably, inking roller 8 and bearing bracket 26 are configured such that, when bearing bracket 26 is pivoted, inking roller 8 will essentially remain in contact with neighboring inking roller 9. Preferably, bearing bracket 26 may essentially be swivelled, or pivoted, by way of the action of a disengaging apparatus provided for engaging and disengaging plate inking roller 10–12 from plate cylinder 13. Thus, essentially, in accordance with a preferred embodiment of the present invention, bearing bracket 26 may preferably be mounted such that it will passively undergo a pivoting movement in response to the lifting motion of plate inking rollers 10, 11, 12, particularly plate inking roller 10. Preferably, the rollers, bearings and brackets described above are configured such that, when plate inking roller 10 is being disengaged from plate cylinder 13, the settings of rollers 5, 7, 8, 9 and 10 essentially do not change.

Figure 2A:
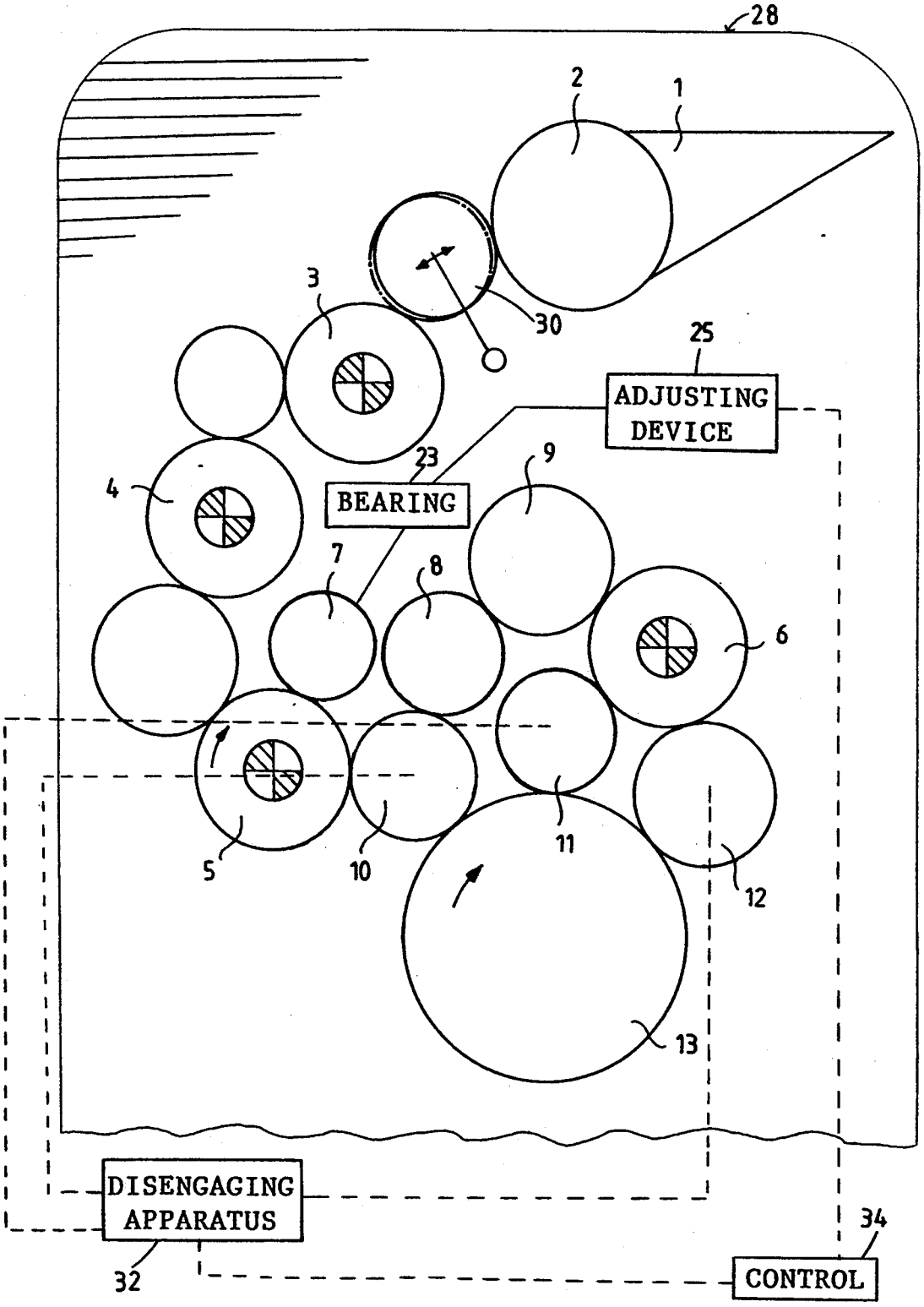
FIG. 2*a* is substantially the same view as FIG. 2, but shows additional components.

FIG. 2*a* illustrates a printing press frame 28 for rotatably supporting various rollers and cylinders of the printing press. A vibrator roller 30, which may be alternatively termed a "transfer roller", is preferably disposed to transfer ink between fountain roller 2 and inking roller 3. In accordance with a preferred embodiment of the present invention, swivel bearing 23 and bearing bracket 26 (see FIG. 1) are both preferably pivotably supported on frame 28. Alternatively, swivel bearing 23 may preferably be mounted on bearing bracket 26 itself. Also, FIG. 2*a* schematically illustrates a disengaging apparatus 32 for selectively engaging and disengaging plate inking rollers 10, 11 and 12 with respect to the plate cylinder 13. Also illustrated is a control arrangement 34, which may preferably be employed to control the disengaging apparatus 32, as well as the adjusting device 25. Preferably, control arrangement 34 may include an arrangement for coordinating the controlling of disengaging apparatus 32 and adjusting device 25 in order to enable the use of disengaging apparatus 32 and adjusting device 25 in conjunction with one another.

One feature of the invention resides broadly in the inking unit for rotary printing machines comprising driven distributor rollers, inking-unit rollers and plate-inking roller mounted so as to be disengageable from a plate cylinder, characterized in that an inking-unit roller 7 with its guidances 18 and a spring element 19 is provided on a swivel bearing 23 which can be swivelled via an adjusting means 25 such that the inking-unit roller 7 is disengaged from a first neighboring roller 8 and remains in contact with a second neighboring distributor roller 5.

Another feature of the invention resides broadly in the inking unit, characterized in that an inking-unit roller 7 and at least one plate-inking roller 10 are assigned to the distributor roller 5, that a further inking-unit roller 8 connecting said aforementioned rollers is mounted on a bearing bracket 26 which can be swivelled about a distributor roller 5 such that the inking-unit roller 8 remains in rolling contact with the following inking-unit roller 9, and that the plate-inking roller 10 is disengaged from the plate cylinder 13.

Examples of general components for printing presses, which may be utilized in accordance with the embodiments of the present invention, may be found in the following U.S. Pat. Nos. 5,010,820, which issued to Löffler on Apr. 30, 1991; and No. 5,081,926, which issued to Rodi on Jan. 21, 1992.

Examples of arrangements for disengaging, or lifting, ink applicator rollers from a plate cylinder, including control arrangements, may be found in the U.S. Patents listed immediately above and also in U.S. Pat. No. 3,809,983 to Garber, entitled "Variable Repeat-Length Web Press".

Examples of swivel bearings, which may be utilized in accordance with the embodiments of the present invention, may be found in the following U.S. Pat. Nos. 4,752,280, which issued to Brandenstein et al. on Jun. 21, 1988; No. 4,690,394, which issued to Maul et al. on Sep. 1, 1987; and No. 4,443,045, which issued to Ketschker et al. on Apr. 17, 1984.

Examples of servomotors, including screw servomotors, which may be utilized in accordance with the embodiments of the present invention, may be found in the following U.S. Pat. Nos. 5,207,749, which issued to Ariyoshi et al. on May 4, 1993; No. 5,029,382, which issued to Breda et al. on Jul. 9, 1991; and No. 5,153,149, which issued to Naito on Oct. 6, 1992.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1 ink fountain
2 fountain roller
3 distributor roller
4 distributor roller
5 distributor roller
6 distributor roller
7 inking-unit roller
*7a* engaged position of inking-unit roller 7
*7b* disengaged position of inking-unit roller 7
8 inking-unit roller
9 inking-unit roller
10 plate-inking roller
11 plate-inking roller
12 plate-inking roller
13 plate cylinder
14 journal
15 journal
16 journal
17 journal
18 guidance
19 spring element
20 spring element
21 spring element
22 tensioning element
23 swivel bearing
*23a* a interconnection between swivel bearing 23 and adjusting means 25
24 point of rotation
25 adjusting means
26 bearing bracket
28 printing press frame
30 vibrator roller
32 disengaging apparatus
34 control arrangement

What is claimed is:

1. A printing press comprising:

a frame;

a plate cylinder being rotatably mounted on said frame;

an ink reservoir for holding a supply of ink;

an inking mechanism for transferring the ink between said ink reservoir and said plate cylinder during operation of said printing press;

said inking mechanism comprising a plurality of inking rollers, at least one ink fountain roller and at least one transfer roller for transferring ink between said ink fountain roller and at least one of said plurality of inking rollers;

a plurality of ink applicator rollers for being engaged with said plate cylinder and for:

receiving ink from said plurality of inking rollers; and applying ink to said plate cylinder; said plurality of inking rollers comprising a first inking roller, a second inking roller and a third inking roller;

means for displacing said first inking roller between a first position and a second position, said first inking roller being rotatingly engaged with both said second inking roller and said third inking roller in said first position, and said first inking roller being disengaged from said second inking roller and rotatingly engaged with said third inking roller in said second position;

said displacing means comprising:

means for accepting a non-orbital movement and translating the non-orbital movement into a pivoting movement of said first inking roller about said third inking roller to displace said first inking roller between said first position and said second position;

said plurality of ink applicator rollers comprising a first ink applicator roller; and each of said second inking roller and said third inking roller being engaged with said first ink applicator roller.

2. The printing press according to claim 1, wherein, in said second position, said first inking roller is engaged only with said third inking roller.

3. The printing press according to claim 2, wherein:

said displacing means further comprises means for continually maintaining said first inking roller in contact with said third inking roller while said first inking roller is being displaced between said first position and said second position; and said means for maintaining contact comprises means for spring-loading said first inking roller to bias said first inking roller against said third inking roller.

4. The printing press according to claim 3, wherein:

said means for accepting the non-orbital movement and translating the non-orbital movement comprises:

means for accepting the non-orbital movement; and means for translating the non-Orbital movement into the pivoting movement of said first inking roller about said third inking roller to displace said first inking roller between said first position and said second position;

said displacing means comprises means for providing the non-orbital movement to be accepted by said accepting means; and said means for providing the non-orbital movement comprises means for providing a linear movement for being translated into the pivoting movement of said first inking roller;

said means for translating the non-orbital movement into the pivoting movement of said first inking roller about said third inking roller comprising bearing means, said bearing means rotatably mounting said first inking roller; and said bearing means being configured for undergoing pivotal displacement in response to the linear movement provided by said means for providing a linear movement, to provide the pivoting movement of said first inking roller about said third inking roller to displace said first inking roller between said first position and said second position.

5. The printing press according to claim 4, wherein said displacing means is configured such that said first inking roller maintains a substantially constant contact pressure with respect to said third inking roller while said first inking roller is being displaced between said first position and said second position.

6. The printing press according to claim 5, further comprising:

said plurality of inking rollers comprising a first set of at least one inking roller and a second set of inking rollers;

said first set of at least one inking roller comprising a train of inking rollers between said at least one transfer roller and said third inking roller;

said second set of inking rollers comprising said first inking roller, said second inking roller and said third inking roller;

said first set of at least one inking roller for transferring ink between said at least one ink transfer roller and said third inking roller;

said plurality of inking rollers further comprising a third set of at least one inking roller;

said plurality of ink applicator rollers comprising a further set of at least one ink applicator roller;

said third set of at least one inking roller comprising a train of at least one inking roller between said second inking roller and said further set of at least one ink applicator roller, for transferring ink between said second inking roller and said further set of at least one ink applicator roller;

said third set of at least one inking roller comprising a fourth of said plurality of inking rollers, said second inking roller being rotatingly engaged with said fourth inking roller;

bearing bracket means rotatably mounting said second inking roller;

said bearing bracket means being pivotably mounted generally about said third inking roller;

means for disengaging said first ink applicator roller from said plate cylinder;

said bearing bracket means being configured for undergoing pivotal displacement about said third inking roller in direct response to the disengagement of said first ink applicator roller from said plate cylinder;

said bearing bracket means being configured such that said second inking roller remains in continual contact with said fourth inking roller during pivotal displacement of said bearing bracket means in response to the disengagement of said first ink applicator roller from said plate cylinder;

said first ink applicator roller being configured to push said second inking roller, to thereby pivotally displace said bearing bracket means about said third inking roller, when said first ink applicator roller is being disengaged from said plate cylinder;

said first set of at least one inking roller comprising:

a fifth inking roller for receiving ink from said at least one ink transfer roller;

a sixth inking roller engaged with said fifth inking roller;

a seventh inking roller engaged with said sixth inking roller;

an eighth inking roller engaged with said seventh inking roller and said third inking roller;

said third set of at least one inking roller comprising a ninth inking roller engaged with said fourth inking roller;

said further set of at least one ink applicator roller comprising a second ink applicator roller and a third ink applicator roller;

said ninth inking roller being engaged with said second ink applicator roller and said third ink applicator roller;

said plate cylinder defining a circumference thereabout and having a direction of rotation, the circumference of said plate cylinder having a minor portion and a major portion, the minor portion being less than the major portion;

said first ink applicator roller being positioned before said second ink applicator roller, as viewed in the direction of rotation of said plate cylinder, and said second ink applicator roller being positioned before said third ink applicator roller, also as viewed in the direction of rotation of said plate cylinder, such that, during operation of said printing press, a point on the plate cylinder is displaced:
past said first ink applicator roller;
thence past said second ink applicator roller;
thence past said third ink applicator roller; and
thence through the major portion of the circumference of said plate cylinder;

each of said first inking roller, said second inking roller, said fourth inking roller and said first ink applicator roller comprising journal means being mounted in said printing press frame;

guidance means for guiding said journal means of each of said first inking roller, said second inking roller, said fourth inking roller and said first ink applicator roller;

said guidance means comprising a pair of guidances disposed tangentially with respect to each of said journal means;

said pair of guidances corresponding to each of said first inking roller, said second inking roller and said fourth inking roller being generally parallel to one another;

said pair of guidances corresponding to said first ink applicator roller being oriented at an acute angle with respect to one another;

said spring-loading means comprising spring means for loading said journal means of said first inking roller in a generally radial direction of said journal means of said inking roller;

spring means for loading said journal means of each of said second inking roller, said fourth inking roller and said first ink applicator roller in a generally radial direction of each of said journal means;

said spring means corresponding to each of said first inking roller, said second inking roller and said fourth inking roller being positioned to load each said journal means in a direction generally parallel to the tangential orientation of said guidances;

said spring means corresponding to said first ink applicator roller being positioned to hold said journal means of said first ink applicator roller in said pair of guidances corresponding to said first ink applicator roller;

means for adjusting the radial loading of each of said spring means;

said means for providing the non-orbital movement comprising one of:
servomotor means; and
adjusting screw means.

7. An inking unit for a printing press, the printing press comprising a frame and a plate cylinder being rotatably mounted on the frame, said inking unit comprising:

an ink reservoir for holding a supply of ink;

an inking mechanism for transferring the ink between said ink reservoir and the plate cylinder during operation of said printing press;

said inking mechanism comprising a plurality of inking rollers, at least one ink fountain roller and at least one transfer roller for transferring ink between said ink fountain roller and at least one of said plurality of inking rollers;

a plurality of ink applicator rollers for being engaged with the plate cylinder and for:
receiving ink from said plurality of inking rollers; and
applying ink to the plate cylinder;

said plurality of inking rollers comprising a first inking roller, a second inking roller and a third inking roller;

means for displacing said first inking roller between a first position and a second position, said first inking roller being rotatingly engaged with both said second inking roller and said third inking roller in said first position, and said first inking roller being disengaged from said second inking roller and rotatingly engaged with said third inking roller in said second position;

said displacing means comprising:
means for accepting a non-orbital movement and translating the non-orbital movement into a pivoting movement of said first inking roller about said third inking roller to displace said first inking roller between said first position and said second position;

means for continually maintaining said first inking roller in contact with said third inking roller while said first inking roller is being displaced between said first position and said second position; and said means for maintaining contact comprising means for spring-loading said first inking roller to bias said first inking roller against said third inking roller.

8. The inking unit according to claim 7, wherein:

said plurality of ink applicator rollers comprises a first ink applicator roller; and each of said second inking roller and said third inking roller are engaged with said first ink applicator roller.

9. The inking unit according to claim 8, wherein, in said second position, said first inking roller is engaged only with said third inking roller.

10. The inking unit according to claim 9, wherein:

said means for accepting the non-orbital movement and translating the non-orbital movement comprises:
means for accepting the non-orbital movement; and
means for translating the non-orbital movement into the pivoting movement of said first inking roller about said third inking roller to displace said first inking roller between said first position and said second position;

said displacing means comprises means for providing the non-orbital movement to be accepted by said accepting means; and said means for providing the non-orbital movement comprises means for providing a linear movement for being translated into the pivoting movement of said first inking rollers.

11. The inking unit according to claim 10, wherein:

said means for translating the non-orbital movement into the pivoting movement of said first inking roller about said third inking roller comprising bearing means, said bearing means rotatably mounting said first inking roller;

said bearing means being configured for undergoing pivotal displacement in response to the linear movement provided by said means for providing a linear movement, to provide the pivoting movement of said first inking roller about said third inking roller to displace said first inking roller between said first position and said second position.

12. The inking unit according to claim 11, wherein said displacing means is configured such that said first inking roller maintains a substantially constant contact pressure with respect to said third inking roller while said first inking roller is being displaced between said first position and said second position.

13. The inking unit according to claim 12, further comprising:

said plurality of inking rollers comprising a first set of at least one inking roller and a second set of inking rollers;

said first set of at least one inking roller comprising a train of inking rollers between said at least one transfer roller and said third inking roller;

said second set of inking rollers comprising said first inking roller, said second inking roller and said third inking roller;

said first set of at least one inking roller for transferring ink between said at least one ink transfer roller and said third inking roller;

said plurality of inking rollers further comprising a third set of at least one inking roller;

said plurality of ink applicator rollers comprising a further set of at least one ink applicator roller;

said third set of at least one inking roller comprising a train of at least one inking roller between said second inking roller and said further set of at least one ink applicator roller, for transferring ink between said second inking roller and said further set of at least one ink applicator roller;

said third set of at least one inking roller comprising a fourth of said plurality of inking rollers, said second inking roller being rotatingly engaged with said fourth inking roller;

bearing bracket means rotatably mounting said second inking roller;

said bearing bracket means being pivotably mounted generally about said third inking roller;

means for disengaging said first ink applicator roller from the plate cylinder;

said bearing bracket means being configured for undergoing pivotal displacement about said third inking roller in direct response to the disengagement of said first ink applicator roller from the plate cylinder;

said bearing bracket means being configured such that said second inking roller remains in continual contact with said fourth inking roller during pivotal displacement of said bearing bracket means in response to the disengagement of said first ink applicator roller from the plate cylinder;

said first ink applicator roller being configured to push said second inking roller, to thereby pivotally displace said bearing bracket means about said third inking roller, when said first ink applicator roller is being disengaged from the plate cylinder;

said first set of at least one inking roller comprising:

a fifth inking roller for receiving ink from said at least one ink transfer roller;

a sixth inking roller engaged with said fifth inking roller;

a seventh inking roller engaged with said sixth inking roller;

an eighth inking roller engaged with said seventh inking roller and said third inking roller;

said third set of at least one inking roller comprising a ninth inking roller engaged with said fourth inking roller;

said further set of at least one ink applicator roller comprising a second ink applicator roller and a third ink applicator roller;

said ninth inking roller being engaged with said second ink applicator roller and said third ink applicator roller;

the plate cylinder defining a circumference thereabout and having a direction of rotation, the circumference of the plate cylinder having a minor portion and a major portion, the minor portion being less than the major portion;

said first ink applicator roller being positioned before said second ink applicator roller, as viewed in the direction of rotation of the plate cylinder, and said second ink applicator roller being positioned before said third ink applicator roller, also as viewed in the direction of rotation of the plate cylinder, such that, during operation of said printing press, a point on the plate cylinder is displaced:

past said first ink applicator roller;

thence past said second ink applicator roller;

thence past said third ink applicator roller; and thence through the major portion of the circumference of the plate cylinder;

each of said first inking roller, said second inking roller, said fourth inking roller and said first ink applicator roller comprising journal means being mounted in said printing press frame;

guidance means for guiding said journal means of each of said first inking roller, said second inking roller, said fourth inking roller and said first ink applicator roller;

said guidance means comprising a pair of guidances disposed tangentially with respect to each of said journal means;

said pair of guidances corresponding to each of said first inking roller, said second inking roller and said fourth inking roller being generally parallel to one another;

said pair of guidances corresponding to said first ink applicator roller being oriented at an acute angle with respect to one another;

said spring-loading means comprising spring means for loading said journal means of said first inking roller in a generally radial direction of said journal means of said inking roller;

spring means for loading said journal means of each of said second inking roller, said fourth inking roller and said first ink applicator roller in a generally radial direction of each of said journal means;

said spring means corresponding to each of said first inking roller, said second inking roller and said fourth inking roller being positioned to load each said journal means in a direction generally parallel to the tangential orientation of said guidances;

said spring means corresponding to said first ink applicator roller being positioned to hold said journal means of said first ink applicator roller in said pair of guidances corresponding to said first ink applicator roller;

means for adjusting the radial loading of each of said spring means;

said means for providing the non-orbital movement comprising one of:

servomotor means; and adjusting screw means.

14. Method of operating a printing press and printing a printed product, said method comprising the steps of:

providing a frame;

providing a plate cylinder and rotatably mounting the plate cylinder on the frame;

providing an ink reservoir for holding a supply of ink;

providing an inking mechanism for transferring the ink between the ink reservoir and the plate cylinder during operation of the printing press;

said step of providing an inking mechanism further comprising the step of providing a plurality of inking rollers, at least one ink fountain roller and at least one transfer roller for transferring ink between the ink fountain roller and at least one of the plurality of inking rollers;

providing a plurality of ink applicator rollers for being engaged with the plate cylinder and for:

receiving ink from the plurality of inking rollers; and applying ink to the plate cylinder;

said step of providing a plurality of inking rollers comprising the step of providing a first inking roller, a second inking roller and a third inking roller;

providing means for displacing the first inking roller between a first position and a second position, the first inking roller being rotatingly engaged with both the second inking roller and the third inking roller in the first position, and the first inking roller being disengaged from the second inking roller and rotatingly engaged with the third inking roller in the second position;

said step of providing the displacing means comprising the step of providing means for accepting a non-orbital movement and translating the non-orbital movement into a pivoting movement of the first inking roller about the third inking roller to displace the first inking roller between the first position and the second position;

said method further comprising the additional steps of:

initiating operation of the printing press;

transferring ink between the ink reservoir and the plate cylinder;

said transferring step comprising the step of transferring the ink between the ink fountain roller and at least one of the plurality of ink applicator rollers;

engaging the plurality of ink applicator rollers with the plate cylinder;

applying ink to the plate cylinder by means of the plurality of ink applicator rollers;

displacing the first inking roller between the first position and the second position such that, in the second position, the first inking roller is engaged only with the third inking roller while maintaining continuous ink transfer between the ink reservoir and the plate cylinder;

said displacing step comprising the step of:

accepting, at the accepting means, a non-orbital movement and translating the non-orbital movement into a pivoting movement of the first inking roller about the third inking roller to displace the first inking roller between the first position and the second position.

15. The inking unit according to claim 14, wherein:

said step of providing the displacing means comprises the step of providing means for maintaining the first inking roller in contact with the third inking roller while the first inking roller is being displaced between the first position and the second position, the means for maintaining contact comprising means for spring-loading the first inking roller to bias the first inking roller against the third inking roller; and said displacing step comprises continually maintaining the first inking roller in contact with the third inking roller, with the spring-loading means.

16. The inking unit according to claim 15, further comprising the step of configuring the printing press such that:

the plurality of ink applicator rollers comprises a first ink applicator roller; and each of the second inking roller and the third inking roller is engaged with the first ink applicator roller.

17. The method according to claim 16, wherein:

said step of providing the means for accepting the non-orbital movement and translating the non-orbital movement to comprises the steps of:

providing means for accepting the non-orbital movement; and providing means for translating the non-orbital movement into the pivoting movement of the first inking roller about the third inking roller to displace the first inking roller between the first position and the second position;

said step of providing the displacing means comprises the step of providing means for providing the non-orbital movement to be accepted by the accepting means;

said step of providing the means for providing the non-orbital movement comprises the step of providing means for providing a linear movement for being translated into the pivoting movement of the first inking roller;

the displacing step comprises the step of:

providing a linear movement to the accepting means; and translating the linear movement into the pivoting movement of the first inking roller.

18. The method according to claim 17, further comprising the steps of:

said step of providing means for translating the non-orbital movement into the pivoting movement of the first inking roller about the third inking roller comprising the step of providing bearing means, the bearing means rotatably mounting the first inking roller;

configuring the bearing means for undergoing pivotal displacement in response to the linear movement provided by the means for providing a linear movement, to provide the pivoting movement of the first inking roller about the third inking roller to displace the first inking roller between the first position and the second position; and pivotally displacing the bearing means in response to the linear movement provided by the means for providing a linear movement, to provide the pivoting movement of the first inking roller about the third inking roller to displace the first inking roller between the first position and the second position.

19. The method according to claim 18, further comprising the steps of:

configuring the displacing means such that the first inking roller maintains a substantially constant contact pressure with respect to the third inking roller while the first inking roller is being displaced between the first position and the second position; and maintaining a substantially constant contact pressure of the first inking roller with respect to the third inking roller while the first inking roller is being displaced between the first position and the second position.

20. The method according to claim 19, further comprising the steps of:

configuring the printing press such that:

the plurality of ink applicator rollers comprises a first ink applicator roller;

each of the second inking roller and the third inking roller is engaged with the first ink applicator roller;

the plurality of inking rollers comprises a first set of at least one inking roller and a second set of inking rollers;

the first set of at least one inking roller comprises a train of inking rollers between the at least one transfer roller and the third inking roller;

the second set of inking rollers comprises the first inking roller, the second inking roller and the third inking roller;

the first set of at least one inking roller is for transferring ink between the at least one ink transfer roller and the third inking roller;

the plurality of inking rollers further comprises a third set of at least one inking roller;

the plurality of ink applicator rollers comprises a further set of at least one ink applicator roller;

the third set of at least one inking roller comprises a train of at least one inking roller between the second inking roller and the further set of at least one ink applicator roller, for transferring ink between the second inking roller and the further set of at least one ink applicator roller;

the third set of at least one inking roller comprises a fourth of the plurality of inking rollers, the second inking roller being rotatingly engaged with the fourth inking roller;

the printing press comprises bearing bracket means rotatably mounting the second inking roller;

the bearing bracket means is pivotably mounted generally about the third inking roller;

the printing press comprises means for disengaging the first ink applicator roller from the plate cylinder;

the bearing bracket means is configured for undergoing pivotal displacement about the third inking roller in direct response to the disengagement of the first ink applicator roller from the plate cylinder;

the bearing bracket means is configured such that the second inking roller remains in continual contact with the fourth inking roller during pivotal displacement of the bearing bracket means in response to the disengagement of the first ink applicator roller from the plate cylinder;

the first ink applicator roller is configured to push the second inking roller, to thereby pivotally displace the bearing bracket means about the third inking roller, when the first ink applicator roller is being disengaged from the plate cylinder;

the first set of at least one inking roller comprises:

a fifth inking roller for receiving ink from the at least one ink transfer roller;

a sixth inking roller engaged with the fifth inking roller;

a seventh inking roller engaged with the sixth inking roller;

an eighth inking roller engaged with the seventh inking roller and the third inking roller;

the third set of at least one inking roller comprises a ninth inking roller engaged with the fourth inking roller;

the further set of at least one ink applicator roller comprises a second ink applicator roller and a third ink applicator roller;

the ninth inking roller is engaged with the second ink applicator roller and the third ink applicator roller;

the plate cylinder defines a circumference thereabout and having a direction of rotation, the circumference of the plate cylinder having a minor portion and a major portion, the minor portion being less than the major portion;

the first ink applicator roller is positioned before the second ink applicator roller, as viewed in the direction of rotation of the plate cylinder, and the second ink applicator roller being positioned before the third ink applicator roller, also as viewed in the direction of rotation of the plate cylinder, such that, during operation of the printing press, a point on the plate cylinder is displaced:

past the first ink applicator roller;

thence past the second ink applicator roller;

thence past the third ink applicator roller; and thence through the major portion of the circumference of the plate cylinder;

each of the first inking roller, the second inking roller, the fourth inking roller and the first ink applicator roller comprises journal means being mounted in the printing press frame;

the printing press comprises guidance means for guiding the journal means of each of the first inking roller, the second inking roller, the fourth inking roller and the first ink applicator roller;

the guidance means comprises a pair of guidances disposed tangentially with respect to each of the journal means;

the pair of guidances corresponding to each of the first inking roller, the second inking roller and the fourth inking roller are generally parallel to one another;

the pair of guidances corresponding to the first ink applicator roller are oriented at an acute angle with respect to one another;

the spring-loading means comprises spring means for loading the journal means of the first inking roller in a generally radial direction of the journal means of the first inking roller;

the printing press comprises spring means for loading the journal means of each of the second inking roller, the fourth inking roller and the first ink applicator roller in a generally radial direction of each of the journal means;

the spring means corresponding to each of the first inking roller, the second inking roller and the fourth inking roller is positioned to load each the journal means in a direction generally parallel to the tangential orientation of the guidances;

the spring means corresponding to the first ink applicator roller is positioned to hold the journal means of the first ink applicator roller in the pair of guidances corresponding to the first ink applicator roller;

the printing press comprises means for adjusting the radial loading of each of the spring means;

the means for providing the non-orbital movement comprises one of:

servomotor means; and adjusting screw means;

transferring ink between the at least one ink transfer roller and the third inking roller via the first set of at least one inking roller;

transferring ink between the second inking roller and the further set of at least one ink applicator roller via the third set of at least one inking roller;

disengaging the first ink applicator roller from the plate cylinder;

pivotally displacing the bearing bracket means in direct response to the disengagement of the first ink applicator roller from the plate cylinder;

maintaining the second inking roller in continual contact with the fourth inking roller during pivotal displacement of the bearing bracket means in response to the disengagement of the first ink applicator roller from the plate cylinder;

pushing the second inking roller, by means of the first ink applicator roller, to thereby pivotally displace the bearing bracket means about the third inking roller, when the first ink applicator roller is being disengaged from the plate cylinder;

loading, by means of the spring means, the journal means of each of the first inking roller, the second inking roller, the fourth inking roller and the first ink applicator roller in a generally radial direction of each of the journal means; and adjusting the radial loading of each of the spring means.

* * * * *

UNITED STATES PATENT AND TRADEMARK OFFICE

CERTIFICATE OF CORRECTION

PATENT NO. : 5,408,928

DATED : April 25, 1995

INVENTOR(S) : Rudi JUNGHANS, et al.

It is certified that error appears in the above-indentified patent and that said Letters Patent is hereby corrected as shown below:

In Column 5, line 16, after 'roller' delete " 7' " and insert --7--.

In Column 9, line 30, Claim 4, after 'the' delete "non-Orbital" and insert --non-orbital--.

In Column 12, line 55, Claim 10, after 'inking' delete "rollers" and insert --roller--.

Signed and Sealed this

Fourteenth Day of November, 1995

*Attest:*

*Attesting Officer*

BRUCE LEHMAN

*Commissioner of Patents and Trademarks*